US006698329B2

(12) United States Patent
Hoffmann et al.

(10) Patent No.: US 6,698,329 B2
(45) Date of Patent: Mar. 2, 2004

(54) METHOD FOR REPLACING A FUSE CASING

(75) Inventors: Wolfgang Hoffmann, Velbert (DE); Wolfgang Schiller, Erkrath (DE); Wolfgang Schmidt, Soest (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/187,174

(22) Filed: Jul. 2, 2002

(65) Prior Publication Data

US 2003/0005817 A1 Jan. 9, 2003

(30) Foreign Application Priority Data

Jul. 3, 2001 (DE) ..... 101 32 175

(51) Int. Cl.[7] ..... F42B 33/10
(52) U.S. Cl. ..... 86/49
(58) Field of Search ..... 86/49

(56) References Cited

U.S. PATENT DOCUMENTS 4,697,061 A * 9/1987 Spaeter et al. ..... 219/121
4,745,862 A * 5/1988 Arnell et al. ..... 102/424
4,825,518 A * 5/1989 Schiestl et al. ..... 86/51
5,106,034 A * 4/1992 Yagla et al. ..... 244/3.24
5,295,428 A * 3/1994 Heitmann et al. ..... 86/49
5,789,695 A * 8/1998 Scherer et al. ..... 86/49
2003/0005817 A1 * 1/2003 Hoffmann et al. ..... 86/49

FOREIGN PATENT DOCUMENTS

DE 4202781 A1 * 8/1993 ..... F42B/33/00

* cited by examiner

*Primary Examiner*—Charles T. Jordan
*Assistant Examiner*—Bret Hayes
(74) *Attorney, Agent, or Firm*—Venable LLP; Stuart I. Smith

(57) ABSTRACT

A method for replacing a fuse casing (4), which is riveted to the casing (2) of an active component (1) containing an explosive charge (3). The new fuse casing (4) laser-welded to the remaining rivet parts (5) of the active component casing (2). Welding filler materials are used to attach the new fuse casing (4) easily and securely to the active component casing (2), such that the connection can withstand even high firing accelerations, without this resulting in impermissibly high thermal stress to the explosive charge (3) in the active component. Welding powders (7) or welding pastes can be used as welding filler materials, which are inserted into gaps (8) remaining between the remaining rivet parts (5) and the bores (6) in the fuse casing (4) before the remaining rivet parts (5) are welded to the fuse casing (4). Also used are discs (9) that cover the bore holes (6) in the fuse casing (4). The disks are placed onto the frontal faces of the remaining rivet parts (5) and are welded to these.

4 Claims, 1 Drawing Sheet

METHOD FOR REPLACING A FUSE CASING

CROSS-REFERENCE TO RELATED APPLICATION

This application claims the priority of German Patent Application No. 101 32 175.9 filed Jul. 30, 2001, which is incorporated herein by reference.

BACKGROUND OF THE INVENTION

The invention relates to a method for replacing a fuse casing riveted to the casing of an active component containing an explosive charge.

The ammunition depots of many countries contain large numbers of projectiles, for which the use period has expired or will expire in a few years. To extend the use period of these projectiles, the old fuses must frequently be replaced with new fuses. This is problematic, particularly with bomblet projectiles, because the old fuses are riveted to the casing for the active component containing the explosive charge and can be removed only by destroying the rivet points or closing heads. As a result, only the remaining rivet parts on the active component casing are available for attaching the new fuse.

In those cases where the original riveting occurred through a one-sided expanding of the rivet point or closing head, it is sufficient—according to a known solution—to mill off only this stressed portion of the rivet point or closing head during the removal of the old fuse and to use the remaining, non-deformed portion for riveting on the new fuse.

The low strength of such a connection has proven to be a disadvantage with this method, particularly if the stress increases due to a higher firing acceleration or a larger mass of the new fuse. A method of this type additionally can be used only if the rivet closing head was simply expanded during the original riveting operation, but not if the wobble riveting method was used.

SUMMARY OF THE INVENTION

It is the object of the invention to provide a method of the aforementioned type for attaching the new fuse casing easily and securely to the active component casing, such that it holds even during high firing stresses, without this resulting in unacceptably high thermal stresses to the explosive charge in the active component.

The object generally is achieved according to the invention by a method for replacing a fuse casing that is riveted to the casing of an active component containing an explosive charge, which method comprises: removing at least a portion of the rivet points of the rivets mounting the fuse casing to the component casing and subsequently removing the fuse casing to be replaced; fitting a new fuse casing onto the casing of the active component, such that the rivet parts remaining on the active component are inserted into bores of the new fuse casing that are provided for the rivets; and, attaching a new fuse casing to the remaining rivet parts by laser welding, and using a welding filler material, starting from a side facing away from the casing of the active component. Additional, particularly advantageous embodiments of the invention are disclosed.

The invention is essentially based on the idea of attaching the new fuse casing to the remaining rivet parts on the active component casing by laser welding and by using welding filler material.

This method can also be used advantageously with bomblets where the old fuse was attached with the wobble riveting method. The method according to the invention furthermore leads to a higher and easier to reproduce strength for the connection between fuse and active component casing as compared to rivets with half a rivet head. Finally, the method according to the invention has the great advantage of being suitable for an automated series production with safety precautions.

Welding powders or welding pastes can be used as filler materials, which are filled into the gap between the remaining rivet parts and the bores in the fuse casing before the rivet remnants are welded to the fuse casing.

It has proven to be particularly advantageous if discs covering the bores in the fuse casing are used as welding fillers. These discs are placed over the fronts of the remaining rivet parts and are welded to the rivet points. The discs can be welded with the aid of welding powders, welding pastes or a welding wire to the remaining rivet parts to compensate for gaps that may exist between the fronts of the remaining rivet parts and the discs.

Further details and advantages of the invention follow from the exemplary embodiments, explained with the aid of Figures, which show in:

DESCRIPTION OF THE PREFERRED EMBODIMENTS

Figure 1:
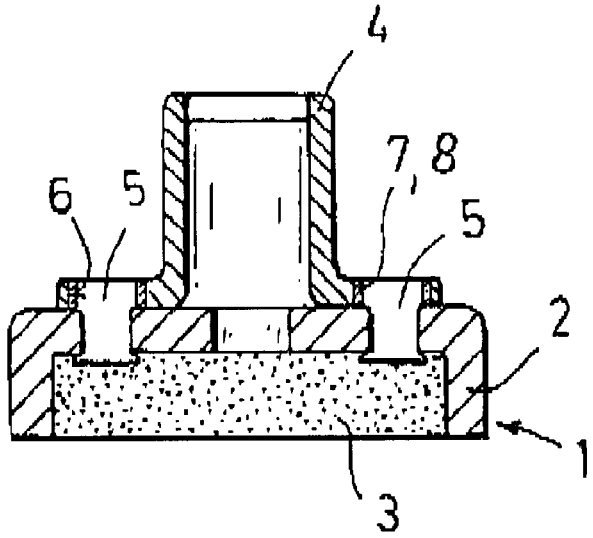
FIG. 1 is a longitudinal section through a fuse casing attached with laser welding to a bomblet active component, wherein welding powder was used as welding filler material.

FIG. 1 shows the fuse area of a bomblet active component 1, comprising a casing 2 with therein disposed explosive charge 3. A fuse is attached to the casing 2 via a fuse casing 4 that has been retrofitted to the component casing 2 after removal of an old fuse casing by partial removal of the rivets holding the old fuse casing.

In order to attach the fuse casing 4 to the active component casing 2, the rivet parts 5, which generally consist of steel and remain on the active component casing 2 following the removal of at least part of the rivet points and dismantling or removal of the old fuse casing, are guided through corresponding bores 6 in the fuse casing 4. On the side facing away from the active component casing 2, the remaining rivet parts 5 are laser-welded on to the fuse casing 4 starting at the end of the rivet facing away from the casing 2. Welding fillers, which in this case are welding powders 7 or welding pastes, are disposed in and fill the gap 8, which is formed between the rivet parts or remnants 5 and the walls defining the bores 6 in the fuse casing 4, before the welding operation begins.

Figure 2:
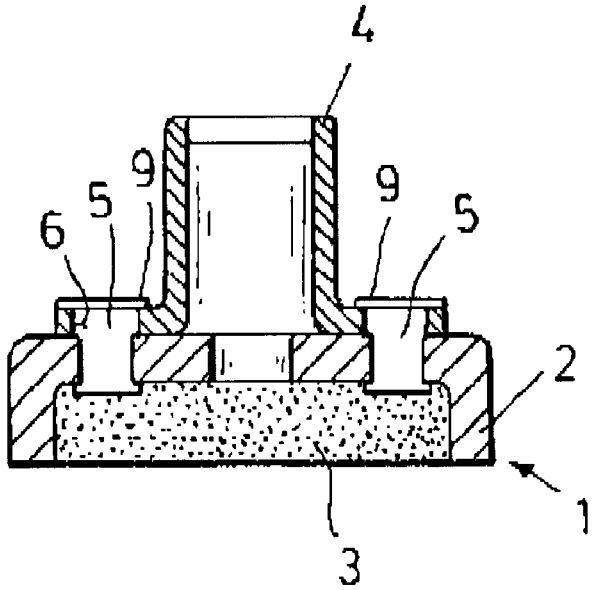
FIG. 2 is a longitudinal section according to FIG. 1, wherein discs covering the bores in the fuse casing are used as welding filler material.

The arrangement in FIG. 2 corresponds to the arrangement in FIG. 1, which shows a bomblet active component 1 with fuse casing 4, wherein discs 9 that cover the bores 6 in the fuse casing 4 are used as welding filler materials. These discs are welded with the laser welding method to the front ends of the remaining rivet parts 5, i.e., the ends from which a portion of the rivets had been removed in order to remove the old casing. Preferably additional welding filler, such as welding powers, welding parts or a welding wire are used to compensate for any gaps that may exist between the rivet parts, the discs 9 and the walls defining the bores 6, but particularly between the ends of the rivet parts 5 and the adjacent surface of discs 9.

The invention now being fully described, it will be apparent to one of ordinary skill in the art that many changes and modifications can be made thereto without departing from the spirit or scope of the invention as set forth herein.

What is claimed is:

1. A method for replacing a fuse casing that is riveted to the casing of an active component containing an explosive charge, said method comprising: removing at least a portion of the rivet points of the rivets mounting the fuse casing to the component casing and subsequently removing the fuse casing to be replaced;

fitting a new fuse casing onto the casing of the active component, such that the rivet parts remaining on the active component are inserted into bores of the new fuse casing that are provided for the rivets; and attaching a new fuse casing to the remaining rivet parts by laser welding, and using a welding filler material, starting from a side facing away from the casing of the active component.

2. A method according to claim 1, wherein at least one of welding powders and welding pastes are used as the welding filler material, and further comprising inserting the welding powder or paste into any gap between the remaining rivet parts and the walls defining the bores of the new fuse casing before the new fuse casing is welded to the remaining rivet parts.

3. A method according to claim 1, wherein metal discs are used as the welding fillers, and further including placing the discs onto front surfaces of the remaining rivet parts to cover the bores in the fuse casing, and welding the discs to the remaining rivet points.

4. A method according to claim 3, wherein the discs are welded to the remaining rivet parts using at least one of a welding powder, a welding paste or a welding wire.

* * * * *